US010327520B1

(12) United States Patent
Ely

(10) Patent No.: US 10,327,520 B1
(45) Date of Patent: Jun. 25, 2019

(54) ATTACHMENT SYSTEM FOR WATCHBAND

(71) Applicant: Apple Inc., Cupertino, CA (US)

(72) Inventor: Colin M. Ely, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 1 day.

(21) Appl. No.: 15/680,138

(22) Filed: Aug. 17, 2017

(51) Int. Cl.

| | |
|---|---|
| ***A44C 5/14*** | (2006.01) |
| ***G04B 37/14*** | (2006.01) |
| ***G04B 47/04*** | (2006.01) |
| ***G04B 37/16*** | (2006.01) |
| ***G04B 37/12*** | (2006.01) |

(52) U.S. Cl.
CPC ..... *A44C 5/14* (2013.01); *A44C 5/147* (2013.01); *G04B 37/12* (2013.01); *G04B 37/1486* (2013.01); *G04B 37/16* (2013.01); *G04B 47/046* (2013.01)

(58) Field of Classification Search
CPC ..... A44C 5/147; A44C 5/14; G04B 37/12; G04B 37/1486; G04B 37/16; G04B 47/046
See application file for complete search history.

(56) References Cited

U.S. PATENT DOCUMENTS 3,165,884 A * 1/1965 Gwinner ..... G04B 37/14 224/164
6,176,612 B1 * 1/2001 Chagnoux ..... A44C 5/14 224/168
6,408,490 B1 * 6/2002 Peguignet ..... G04B 37/1486 24/265 B
6,457,215 B1 * 10/2002 Martin ..... A44C 5/14 24/265 EC
2005/0111306 A1 * 5/2005 Saaski ..... A44C 5/14 368/282
2005/0217080 A1 * 10/2005 Kojoori ..... A44B 11/006 24/265 WS
2005/0265132 A1 * 12/2005 Ho ..... G04B 37/1486 368/282
2006/0126445 A1 * 6/2006 Bouille ..... A44C 5/14 368/281
2007/0143970 A1 * 6/2007 Loetscher ..... A44C 5/14 24/265 B (Continued)

FOREIGN PATENT DOCUMENTS

FR 3021128 A1 * 11/2015 ..... A44C 5/147

*Primary Examiner* — Daniel P Wicklund
(74) *Attorney, Agent, or Firm* — Morgan, Lewis & Bockius LLP

(57) ABSTRACT

Wearable electronic devices, such as watches, can be provided with an attachment system for connecting and releasing a removable module that interfaces with some portion of the electronic device. For example, a watch can include locking mechanisms that allow a user to connect a watchband to a watch housing by moving the watchband directly toward the watch housing. An attachment unit of a watchband can be moved in a direction along its own longitudinal axis to securely engage the watch housing. Once engaged, one or more locking mechanisms limit longitudinal movement of the attachment unit away from the watch housing. One or more locking mechanisms also limit lateral movement of the attachment unit with respect to the watch housing until a user releases the one or more locking mechanisms and enables the lateral movement.

17 Claims, 8 Drawing Sheets

(56) References Cited

U.S. PATENT DOCUMENTS

| | | | | |
|---|---|---|---|---|
| 2007/0189126 | A1* | 8/2007 | Hiranuma | A44C 5/14 368/282 |
| 2010/0302914 | A1 | 12/2010 | Faucher et al. | |
| 2011/0007468 | A1 | 1/2011 | Burton et al. | |
| 2014/0353349 | A1* | 12/2014 | De Oliveira | A44C 5/14 224/164 |
| 2016/0040698 | A1* | 2/2016 | Perkins | A44B 17/0011 24/664 |
| 2018/0011448 | A1* | 1/2018 | Von Allmen | G04B 37/18 |

* cited by examiner

ATTACHMENT SYSTEM FOR WATCHBAND

TECHNICAL FIELD

The present description relates generally to securement of wearable devices, and, more particularly, to attachment systems for watchbands.

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device to the user can depend on the function and arrangement of the watchband.

Consumer products such as watches, cameras, phones, purses, and glasses may include one or more accessories attached thereto. The manner in which they are attached may be widely varied. However, they typically suffer from similar, if not the same, drawbacks. For example, many consumer products typically do not include user-friendly attachment systems. Some may require special tools and others may even require taking the consumer product into a shop in order to remove, fix or replace the accessories. Furthermore, even when products have user oriented attachment mechanisms, they may not provide adequate retention force. Even if the retention force is adequate, the mechanism used may be quite robust and large thereby adversely affecting the elegance of the consumer product.

In one example, wristwatches typically include a case and a band. The case carries the components or mechanisms of the wristwatch including the face. The band extends away from the case so that it can wrap around the wrist of a user. The band may be integral with the case. However, in most cases, the band is a separate part that is attached to the case. For example, the case may include a pin that captures the band thereby attaching the band to the case. In order to detach the band from the case, the pin needs to be removed. In some instances, band removal can be accomplished with a special tool. However, in many cases, the user may need to visit a specialty store or have the assistance of technician in order to remove the band.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
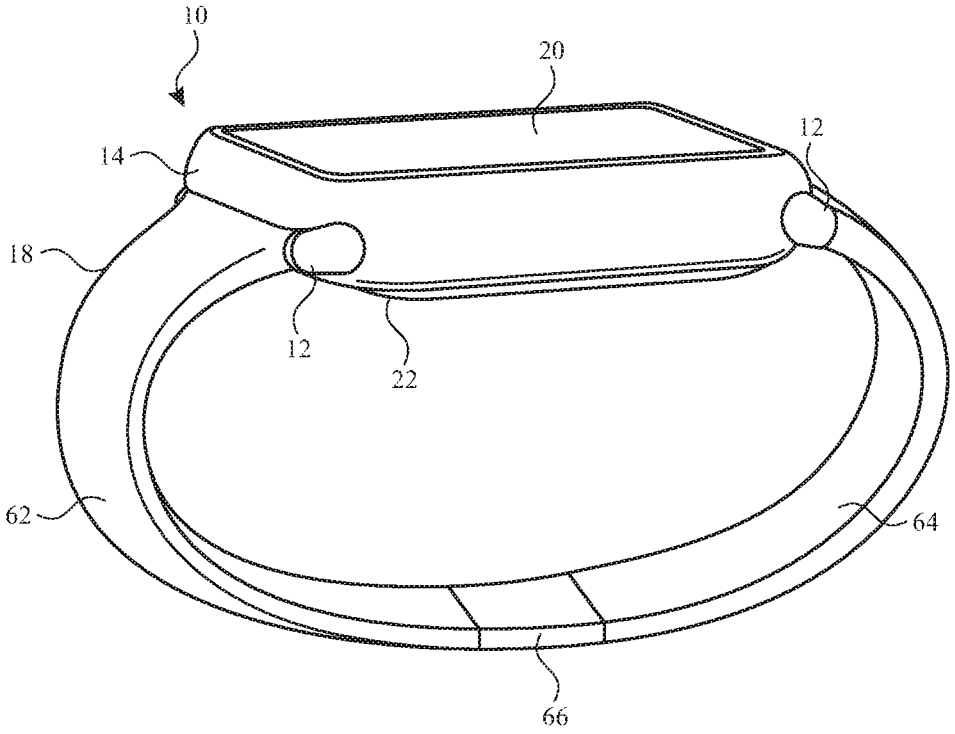
FIG. 1 shows a perspective view of an exemplary watch.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Wearable electronic devices, such as watches, can be provided with an attachment system for connecting and releasing a removable module that interfaces with some portion of the electronic device. For example, a watch can include watchbands that connect to a watch housing and secure the watch housing to a wrist of a user. The watchbands engage with a related or corresponding module, recess, aperture, or component of the watch housing. Attachment systems for such modules are desired to provide ease of connection, secure retention, ease of release, and aesthetic qualities. For example, an attachment system for a watch is desired to retain and selectively release a watchband without adversely affecting the look and feel of the watch.

Some watches are provided with a locking mechanism that requires particular operation to achieve a secure connection. For example, some watches require that a watchband be inserted into and removed from a housing of a watch in a particular direction. The direction of the insertion and removal may be limited to lateral movements. For example, to prevent a watchband from being inadvertently detached from a watch housing, some watches require lateral movement to remove the watchband. Such designs may prevent both insertion and removal of a watchband with movements that are directly toward or away from the watch housing.

Embodiments of the present disclosure provide locking mechanisms that allow a user to connect a watchband to a watch housing by moving the watchband directly toward the watch housing. For example, an attachment unit of a watchband can be moved in a direction along its own longitudinal axis to securely engage the watch housing. Connecting the watchband to the watch housing with movement directly toward the watch housing can feel more natural than other movements (e.g., across the housing). Once engaged, one or more locking mechanisms limit longitudinal movement of the attachment unit away from the watch housing. One or more locking mechanisms also limit lateral movement of the attachment unit with respect to the watch housing until a user releases the one or more locking mechanisms and enables the lateral movement. Thus, the attachment unit of the watchband is securely engaged with the watch housing until released by a user.

These and other embodiments are discussed below with reference to FIGS. 1-20. However, those skilled in the art will readily appreciate that the detailed description given herein with respect to these Figures is for explanatory purposes only and should not be construed as limiting.

FIG. 1 illustrates an exemplary electronic device that includes or is useable with an attachment unit of an attachment system. The electronic device can be a wearable electronic device, such as a wrist-worn watch 10. Additionally or alternatively, the electronic device can be a portable computing device. Examples include cell phones, smart phones, tablet computers, laptop computers, timekeeping devices, computerized glasses and other wearable devices navigation devices, sports devices, accessory devices, health-monitoring devices, medical devices, wristbands, bracelets, jewelry, and/or the like.

One of the components included in the watch 10 can be one or more I/O systems. For example, the watch 10 can include a display 20 configured to output various information about the watch 10. The display 20 of the watch 10 can also be configured to receive input. The watch 10 can also have other input and output mechanisms. For example, the watch 10 can include or interface with one or more buttons, a crown, keys, dials, trackpads, microphones and the like.

The watch 10 can include a housing 14 and one or more attachment units 12 capable of being removably coupled to the housing 14. The housing 14 serves to surround a peripheral region of the watch 10 as well as support the internal components of the watch 10 in their assembled position. For example, the housing 14 encloses and supports various internal components (including for example integrated circuit chips, processors, memory devices and other circuitry) to provide computing and functional operations for the watch 10.

The watch 10 can be a wrist-worn device that utilizes a band 18 for attaching the watch 10 to a wrist. For example, as shown in FIG. 1, the band 18 can include a first band strap 62 attached to a first attachment unit 12 of the watch 10 and a second band strap 64 attached to a second attachment unit 12 of the watch 10. In some embodiments, free ends of the first band strap 62 and the second band strap 64 can be configured to be releasably attached or secured to one another using a clasp 66 or other attachment mechanism to form a loop. This loop can then be used to attach the watch 10 to a user's wrist.

Although a single attachment unit 12 is discussed herein, a plurality of attachment units 12 can be coupled to the watch 10. When multiple attachment units 12 are used, as shown in FIG. 1, the watch 10 can have a channel or other such coupling node on a first side of the housing 14 and a second channel or other such coupling node on a second side of the housing 14, as described further herein. The channel on the first side of the housing 14 of the watch 10 can receive one of the attachment units 12 and the channel on the second side of the housing 14 of the watch 10 can receive another attachment unit 12. The attachment units 12 can have a same or different size and/or shape, wherein the size and/or shape corresponds to a size and/or shape of the respective channel. The housing 14 includes one or more channels that mechanically engage a corresponding attachment unit 12 as will be described in detail below.

Figure 2:
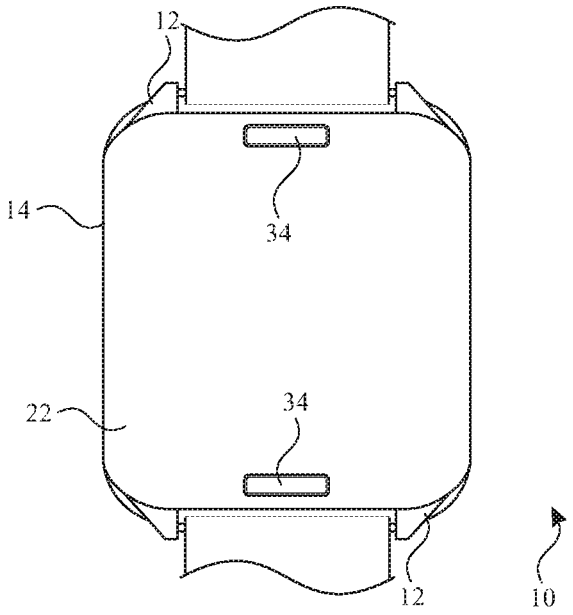
FIG. 2 shows a rear view of an exemplary watch housing of the watch of FIG. 1.

FIG. 2 illustrates a bottom view of the watch 10 of FIG. 1. A locking member 34 can be disposed on an underside of the housing 14. Alternatively or additionally, the locking member 34 can be disposed or positioned on a top side of the housing 14. The locking member 34 can be used to release the attachment unit 12 from the channel, as discussed further herein. Actuation of the locking member 34 releases the attachment unit 12, which enables the attachment unit 12 to be removed from the channel.

As used herein, "longitudinal" and "longitudinally" refer to a direction that is along or parallel to a long axis of the band as it extends away from the housing 14 when connected thereto. For example, "longitudinal" and "longitudinally" can refer to a direction that is away from the housing 14 and through the band or a substantial portion thereof. As used herein, "lateral" and "laterally" refer to a direction that is along or parallel to a long dimension of the channel that extends across a side of the housing 14. For example, "lateral" and "laterally" can refer to a direction that is through the channel and the attachment unit 12. By further example, a longitudinal direction and a lateral direction can be orthogonal to each other.

Figure 3:
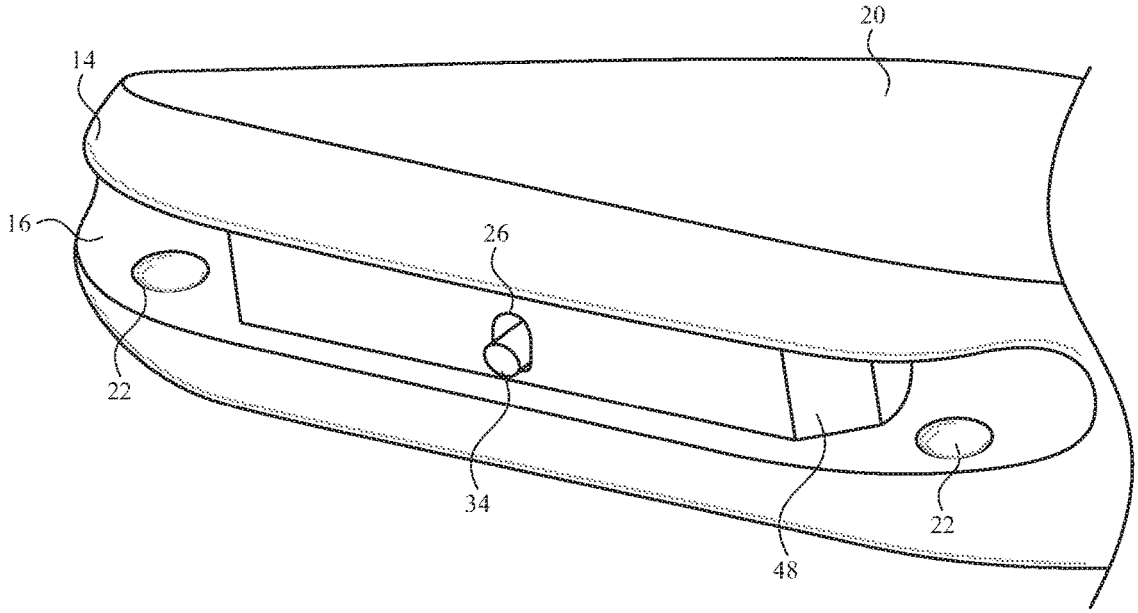
FIG. 3 shows a perspective view of the watch housing of FIG. 2.

FIG. 3 illustrates a perspective view of the housing 14 of an electronic device, such as the watch 10 of FIG. 1. The housing 14 includes one or more channels 16 for receiving a corresponding attachment unit of a band. The channel 16 has a size and shape that permits longitudinal and lateral movement of the attachment unit within the channel 16.

Within the channel 16, the housing 14 can provide one or more recesses 22. Each recess 22 is configured to receive a corresponding catch member of an attachment unit. The recesses 22 provide secure and stable retention of the attachment unit by limiting a longitudinal movement of the attachment unit out of the channel 16 without limiting a lateral movement of the attachment unit within the channel 16, as discussed further herein. The recesses 22 can be positioned within regions of the channel 16 that have a greater longitudinal depth. For example, adjacent to one or more recesses 22, a portion of the housing 14 can protrude into the channel 16 with a housing incline surface 48. While two recesses 22 are shown in FIG. 3, any number of recesses 22 can be provided, such as 1, 2, 3, 4, 5, 6, 7, 8, or more than 8 recesses 22.

The housing 14 can include a locking member 34 configured to releasably engage the attachment unit to limit a lateral movement of the attachment unit within the channel 16, as discussed further herein. As shown in FIG. 3, the locking member 34 can reside and move within a locking chamber 26 of the housing 14. The locking member 34, or a portion thereof, can extend into the channel 16, for example at a location that is laterally between multiple recesses 22.

Figure 4:
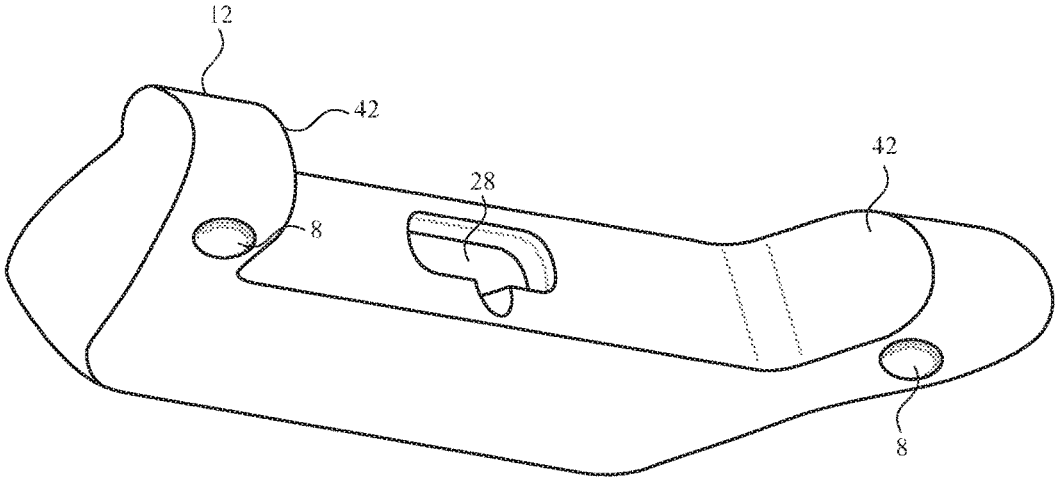
FIG. 4 shows a perspective view of an exemplary attachment unit of a watchband.
Figure 5:
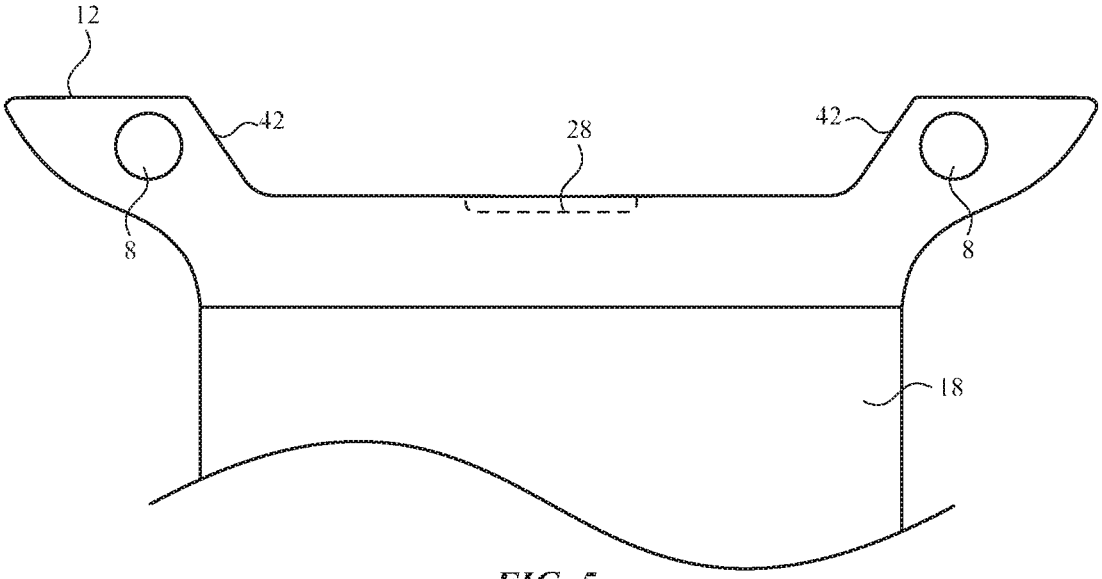
FIG. 5 shows a side view of the attachment unit of FIG. 4.

FIGS. 4 and 5 illustrate perspective and side views of the attachment unit 12 of a band, such as the band 18 of FIG. 1. The attachment unit 12 can include a shape that is generally complementary of a shape of the channel 16. For example, the attachment unit 12 can include an attachment incline surface 42 for contacting the housing incline surface 48 of the housing 14 when the attachment unit 12 is moved laterally within the channel 16.

The attachment unit 12 can include one or more catch members 8 that are retractably biased to engage the housing 14. Each of the catch members 8 is configured to extend into a corresponding recess 22 of the housing 14. Each of the catch members 8 can be positioned to align with a corresponding one of the recesses 22 when the attachment unit 12 is inserted into the channel 16. While two catch members 8 are shown in FIGS. 4 and 5, any number of catch members 8 can be provided, such as 1, 2, 3, 4, 5, 6, 7, 8, or more than 8 catch members 8.

The attachment unit 12 can include an opening 28 configured to receive the locking member 34 of the housing 14. The opening 28 can be positioned to align with the locking member 34 when the attachment unit 12 is inserted into the channel 16. The opening 28 can be positioned at a location that is laterally between catch members 8.

The attachment unit 12 and the housing 14 can include components for wired or wireless communications between the attachment unit 12 of the housing 14. For example, when the attachment unit 12 is within the channel 16 of the housing 14, contact electrodes on both the attachment unit 12 and the housing 14 can provide electrical conduction across the interface. Additionally or alternatively, when the attachment unit 12 is within the channel 16 of the housing 14, components (e.g., coils) can be aligned to be inductively coupled. Electrical contact can be achieved by one or more of the components illustrated herein. For example, the catch members 8 and the recesses 22 can act as a contact electrodes for communication between the attachment unit 12 of the housing 14. By further example, the locking member 34 and the opening 28 can act as a contact electrodes for communication between the attachment unit 12 of the housing 14. The housing 14 can include a variety of components at the channel 16. For example, the housing can provide one or more connectors, sensors, vents, microphones, speakers, and/or interface elements.

Figure 6:
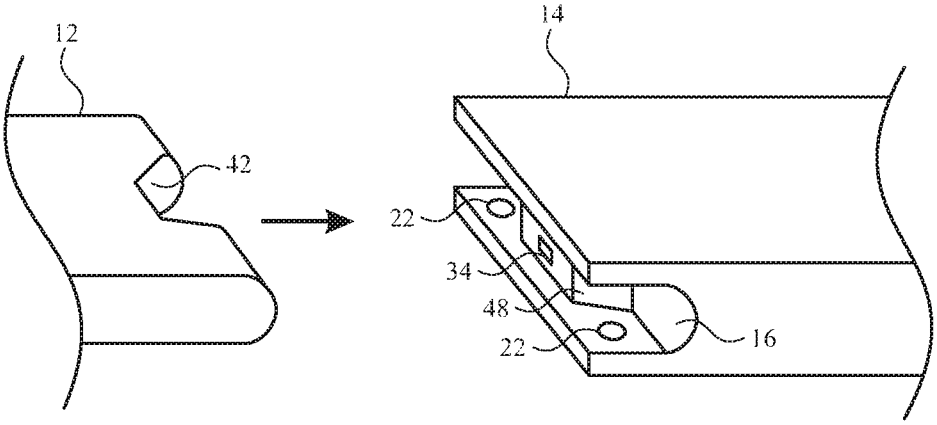
FIG. 6 shows a perspective view of an exemplary attachment unit of a watchband in a first stage of an engagement process.
Figure 7:
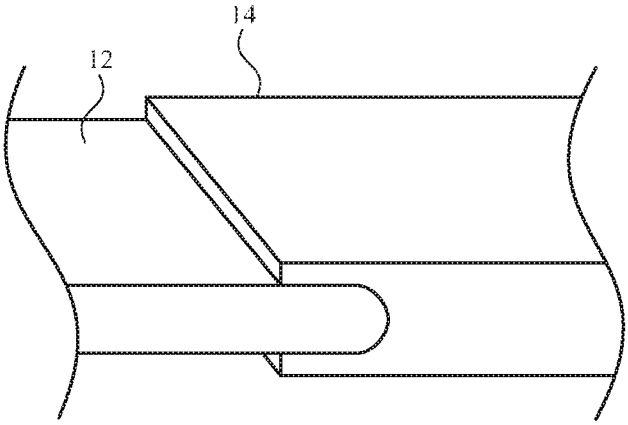
FIG. 7 shows a perspective view of the attachment unit and watch housing of FIG. 6 in a second stage of an engagement process.

Referring now to FIGS. 6-9, engagement of the attachment unit 12 and the housing 14 is described. As shown in FIGS. 6 and 7, the attachment unit 12 can be positioned longitudinally across from the channel 16 of the housing 14. The attachment unit 12 can be moved in a longitudinal direction to be inserted into the channel 16. The channel 16 receives the attachment unit 12 through a longitudinal side thereof. Upon entering the channel 16, the attachment unit 12 can engage the housing 14.

Figure 8:
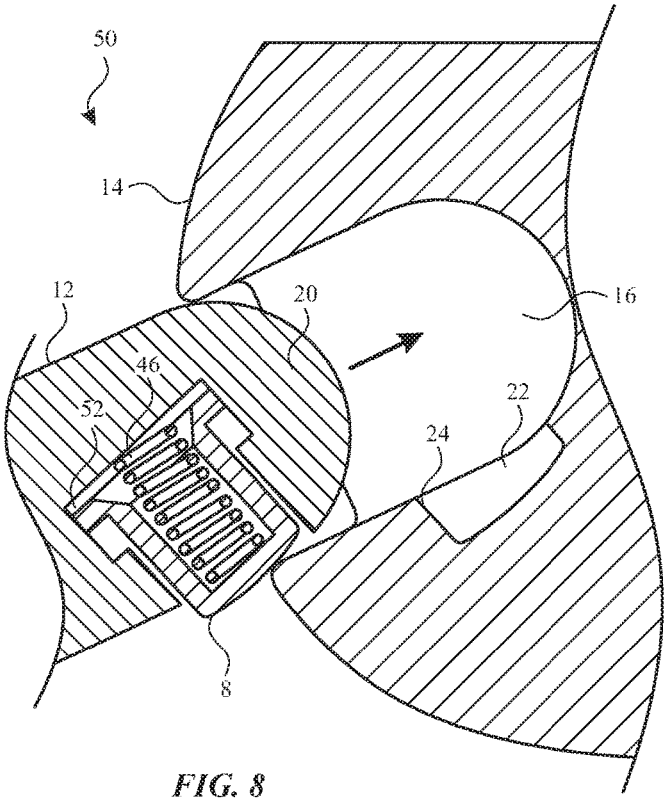
FIG. 8 shows a sectional view of an exemplary attachment unit and watch housing in a first stage of an engagement process.
Figure 9:
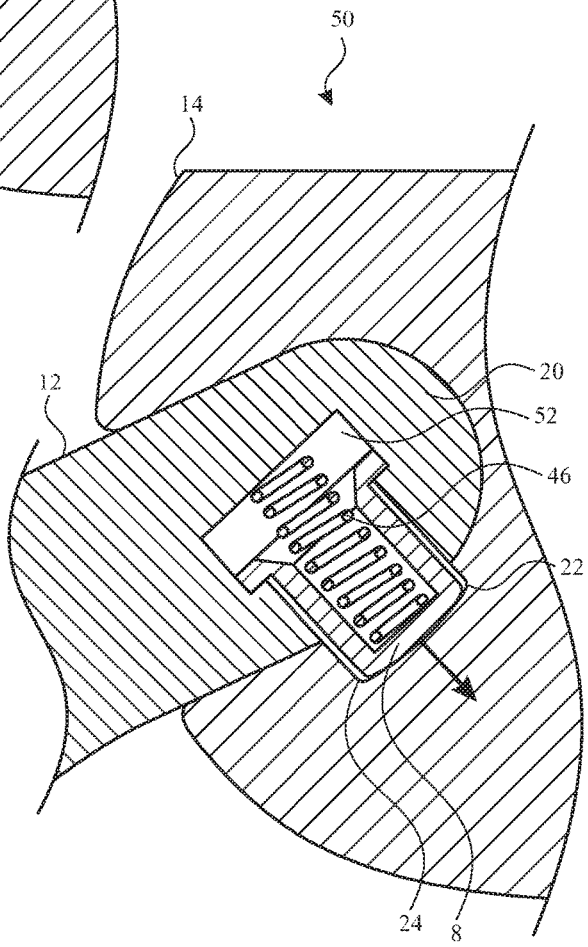
FIG. 9 shows a sectional view of the attachment unit and watch housing of FIG. 8 in a second stage of an engagement process.

As shown in FIGS. 8 and 9, a longitudinal lock mechanism 50 facilitates an engagement between the attachment unit 12 and the housing 14. The longitudinal lock mechanism 50 can include components of the attachment unit 12, the housing 14, or both. For example, the longitudinal lock mechanism 50 can include the catch member 8 and the recess 22. The components can interact with each other to facilitate a secure and releasable engagement between the attachment unit 12 and the housing 14. The engagement provided by the longitudinal lock mechanism 50 can limit longitudinal movement of the attachment unit 12 away from the housing 14 (e.g., out of a longitudinal side of the channel 16).

As further shown in FIGS. 8 and 9, the catch member 8 of the attachment unit 12 are retractably biased within a catch chamber 52 of the attachment unit 12. For example, the spring elements 46 can be provided to bias the catch member 8 in a position that protrudes from a body of the attachment unit 12. Upon entry of the attachment unit 12 into the channel 16, the housing 14 can interact with the catch member 8 to cause it to retract and allow passage of the attachment unit 12 into the channel 16. When the catch member 8 is aligned with the recess 22, the spring element 46 urges the catch member 8 into the recess 22. While within the recess 22, a ledge 24 of the recess 22 can engage the catch member 8. For example, the ledge 24 can have a shape that does not urge the catch member 8 to retract when a longitudinal (e.g., pulling) force is applied to the attachment unit 12. As such, once the catch member 8 is within the recess 22, the catch member 8 must be retracted by another mechanism to exit the recess 22, as discussed further herein. While the recess 22 engages the catch member 8 to limit a longitudinal movement of the attachment unit 12 out of the channel 16, the recess 22 does not limit lateral movement of the attachment unit 12 within the channel 16.

While the longitudinal lock mechanism 50 is shown as including a catch member 8 of an attachment unit 12 and a recess 22 of a housing 14, it will be recognized that the arrangement of parts can be altered to provide the same or similar functionality. For example, a longitudinal lock mechanism 50 can include a catch member positioned on the housing 14 (e.g., within the channel 16) and a recess on the attachment unit 12. Despite the exchange of positions, the catch member and recess can function the same or similarly to the illustrated embodiments to facilitate an engagement between the attachment unit 12 and the housing 14 and to releasably limit longitudinal movement of the attachment unit 12 away from the housing 14 (e.g., out of a longitudinal side of the channel 16).

Figure 10:
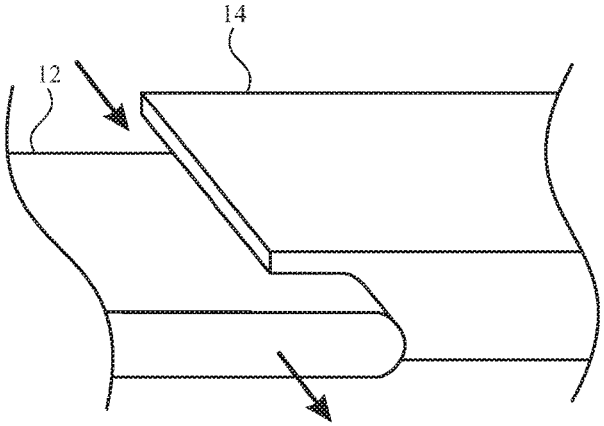
FIG. 10 shows a perspective view of an exemplary attachment unit of a watchband in a first stage of a disengagement process.
Figure 11:
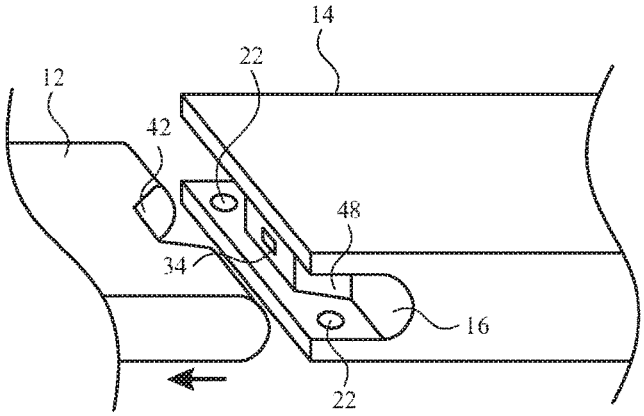
FIG. 11 shows a perspective view of the attachment unit and watch housing of FIG. 10 in a second stage of a disengagement process.

Referring now to FIGS. 10-20, disengagement of the attachment unit 12 and the housing 14 is described. As shown in FIGS. 10 and 11, the attachment unit 12 can be moved laterally and then longitudinally with respect to the housing 14. For example, the attachment unit 12 is initially prevented from moving longitudinally away from the housing 14. As shown in FIG. 10, upon release of the longitudinal lock mechanism 50 by a user, the attachment unit 12 can move laterally. As shown in FIG. 11, the attachment unit 12 can move longitudinally to separate from the housing 14.

As shown in FIGS. 12-15, a lateral lock mechanism 60 facilitates an engagement between the attachment unit 12 and the housing 14. The lateral lock mechanism 60 can include components of the attachment unit 12, the housing 14, or both. For example, the lateral lock mechanism 60 can include the locking member 34 and the opening 28. The components can interact with each other to facilitate a secure and releasable engagement between the attachment unit 12 and the housing 14. The engagement provided by the lateral lock mechanism 60 can limit lateral movement of the attachment unit 12 with respect to the housing 14 (e.g., within or at least partially out of a lateral side of the channel 16).

Figure 12:
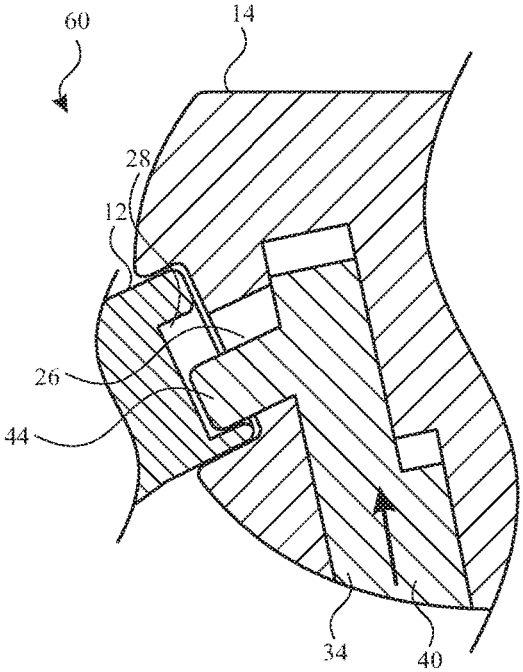
FIG. 12 shows a sectional view of an exemplary attachment unit and watch housing in a first stage of a disengagement process.
Figure 13:
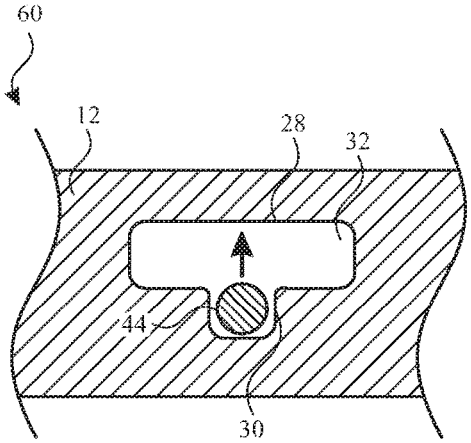
FIG. 13 shows a sectional view of the attachment unit and watch housing of FIG. 12 in the first stage of a disengagement process.

As shown in FIGS. 12 and 13, upon entry of the attachment unit 12 into the channel 16, the locking member 34 of the housing 14 can engage the opening 28 of the attachment unit 12. The locking member 34 can moveably reside within a locking chamber 26 of the housing 14. The locking member 34 can include an engagement portion 44 and an interface portion 40. The engagement portion 44 of the locking member 34 can extend at least partially into the channel 16 to engage the opening 28 when the attachment unit 12 is within the channel 16. The interface portion 40 of the engagement portion 44 can extend to a side of the housing 14 that is accessible to a user.

The opening 28 of the attachment unit 12 can include a first portion 30 and a second portion 32. The second portion 32 can have a lateral width that is greater than a lateral width of the first portion 30. While the engagement portion 44 is within the first portion 30, the lateral movement of the attachment unit 12 is limited by the lateral width of the first portion 30. The locking member 34 can be retractably biased to a position in which the interface portion 40 is flush with the body of the housing 14 and the engagement portion 44 is within the first portion 30 of the opening 28. The locking member 34 can be biased by a biasing member (not shown) such as a spring in the locking chamber 26.

Figure 14:
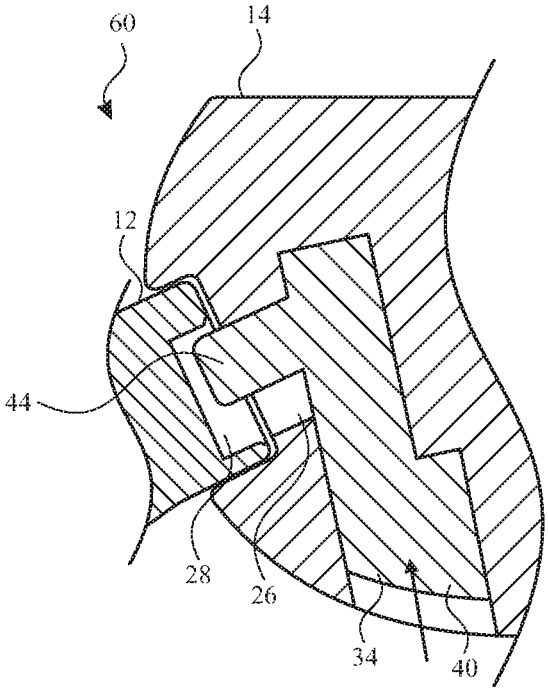
FIG. 14 shows a sectional view of an exemplary attachment unit and watch housing in a second stage of a disengagement process.
Figure 15:
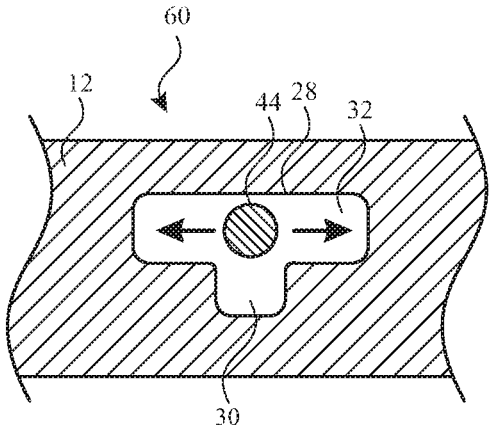
FIG. 15 shows a sectional view of the attachment unit and watch housing of FIG. 14 in the second stage of a disengagement process.

As shown in FIGS. 14 and 15, the locking member 34 can be moved within the locking chamber 26. For example, a user can press the interface portion 40 of the locking member 34 is to advance the locking member 34. As the locking member 34 advances, the engagement portion 44 can move from the first portion 30 of the opening 28 to the second portion 32 of the opening 28. Because the second portion 32 has a lateral width that is greater than a lateral width of the first portion 30, the lateral movement available to the attachment unit 12 is greater when the engagement portion 44 is within the second portion 32 than it is when the engagement portion 44 is within the first portion 30. Accordingly, the lateral lock mechanism 60 can be disengaged by operation of the locking member 34.

While the locking member 34 of the housing 14 is shown as moving in a particular direction with respect to the attachment unit 12, it will be recognized that other arrangements can be provided to achieve the same or similar functionality. For example, a locking member of the housing 14 can extend into an opening of the attachment unit 12 that is located on a top or bottom surface of the attachment unit 12.

While the lateral lock mechanism 60 is shown as including an opening 28 of an attachment unit 12 and a locking member 34 of a housing 14, it will be recognized that the arrangement of parts can be altered to provide the same or similar functionality. For example, a lateral lock mechanism 60 can include an opening positioned on the housing 14 (e.g., within the channel 16) and a locking member on the attachment unit 12. Despite the exchange of positions, the locking member and opening can function the same or similarly to the illustrated embodiments to facilitate an engagement between the attachment unit 12 and the housing 14 and to releasably limit lateral movement of the attachment unit 12 with respect to the housing 14 (e.g., within or at least partially out of a lateral side of the channel 16). Release of the lateral lock mechanism 60 can be achieved by manipulation of the attachment unit 12 and/or the housing 14.

Figure 16:
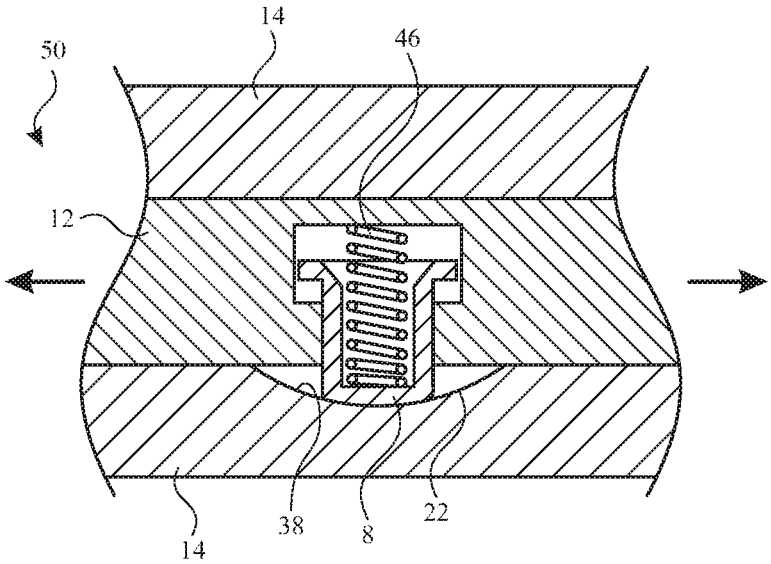
FIG. 16 shows a sectional view of an exemplary attachment unit and watch housing in a first or second stage of a disengagement process.
Figure 17:
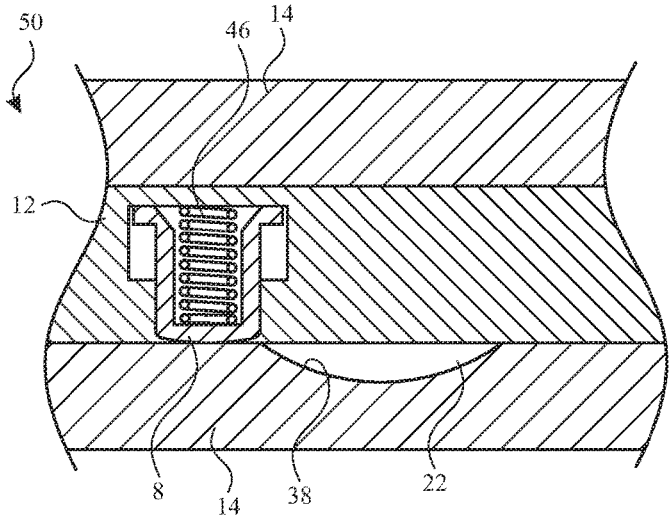
FIG. 17 shows a sectional view of the attachment unit and watch housing of FIG. 16 in a third stage of a disengagement process.

The lateral movement of the attachment unit 12 can achieve disengagement of the longitudinal lock mechanism 50. As shown in FIGS. 16 and 17, the recess 22 of the housing 14 can include a ramp 38 on a lateral side of the catch member 8. In contrast to the ledge 24 (see FIGS. 8 and 9) of the recess 22, the ramp 38 allows movement of the attachment unit 12 by facilitating retraction of the catch member 8. In particular, as the attachment unit 12 moves laterally with respect to the housing 14, the catch member 8 moves up the ramp 38, which is shaped to cause gradual retraction of the catch member 8 until the catch member 8 is entirely out of the recess 22. When the catch member 8 is no longer within the recess 22, the ledge 24 no longer prevents longitudinal movement of the attachment unit 12 out of the channel 16. Accordingly, the longitudinal lock mechanism 50 can be disengaged by lateral movement of the attachment unit 12 with respect to the housing 14.

Figure 18:
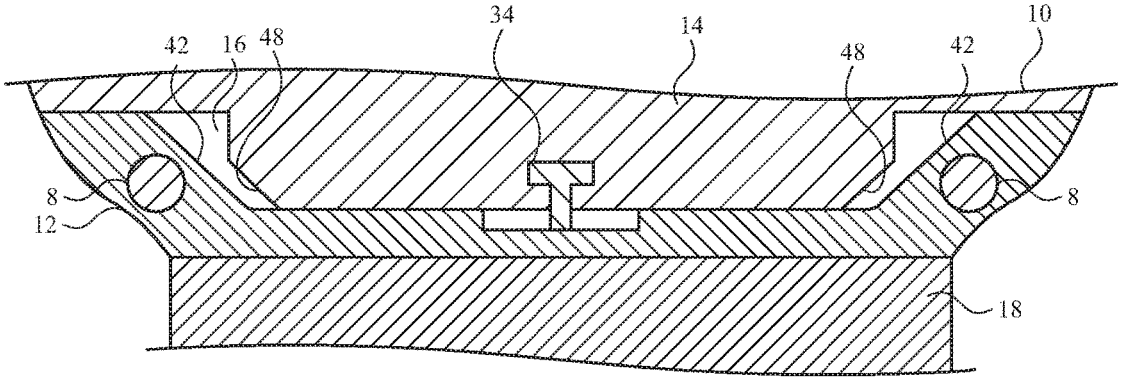
FIG. 18 shows a sectional view of an exemplary attachment unit and watch housing in a first or second stage of a disengagement process.

Disengagement of the longitudinal lock mechanism 50 and the lateral lock mechanism 60 allows the attachment unit 12 to be removed from the housing 14. In a disengagement process, the attachment unit 12 can move laterally and then longitudinally out of the channel 16. As shown in FIG. 18, the attachment unit 12 can initially be positioned within the channel 16. When engaged therein, the attachment incline surface 42 can be positioned across the housing incline surface 48. A lateral gap can be provided between the attachment incline surface 42 and the housing incline surface 48 so that the attachment unit 12 can move laterally within the channel 16 before contact between the attachment incline surface 42 and the housing incline surface 48 occurs. For example, a maximum lateral distance between opposing attachment incline surfaces 42 of the attachment unit 12 can be greater than a maximum lateral distance between opposing housing incline surfaces 48 of the housing 14.

Figure 19:
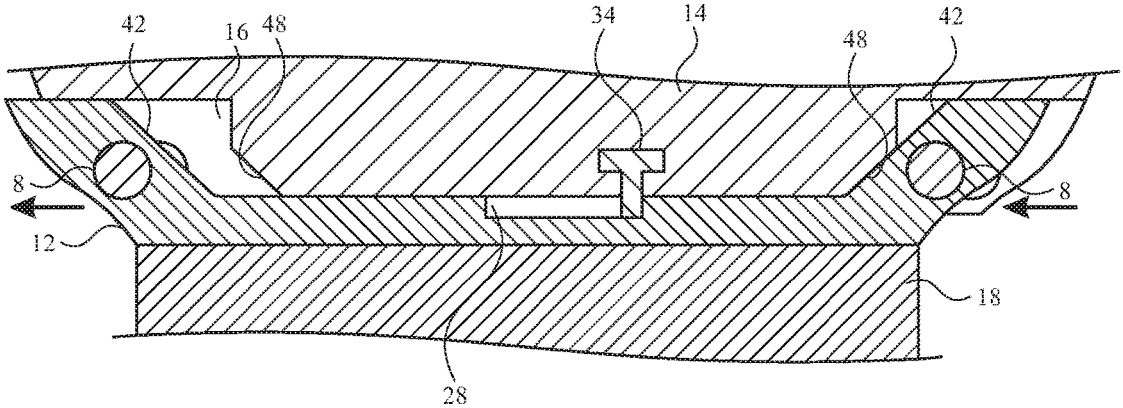
FIG. 19 shows a sectional view of the attachment unit and watch housing of FIG. 18 in a third stage of a disengagement process.

As shown in FIG. 19, when the lateral lock mechanism 60 is disengaged, the attachment unit 12 can move laterally within the channel 16 at least until the attachment incline surface 42 contacts the housing incline surface 48. As discussed herein, the lateral movement can achieve disengagement of the longitudinal lock mechanism 50.

Figure 20:
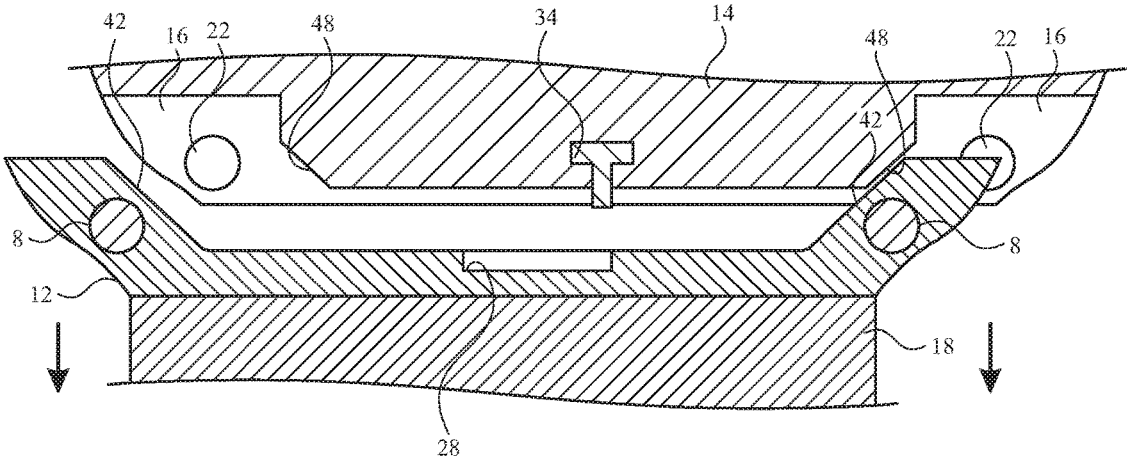
FIG. 20 shows a sectional view of the attachment unit and watch housing of FIG. 18 in a fourth stage of a disengagement process.

As shown in FIG. 20, when the longitudinal lock mechanism 50 is disengaged, the attachment unit 12 can move longitudinally out of the channel 16. The longitudinal movement of the attachment unit 12 can be accompanied by a degree of lateral movement. For example, the attachment unit 12 can move diagonally in a direction that has both a longitudinal and lateral component. By further example, the attachment unit 12 can move in a manner that is guided by an interaction between the attachment incline surface 42 and the housing incline surface 48. At least a portion of the attachment incline surface 42 can be parallel to a least a portion of the housing incline surface 48. As a lateral force is applied to the attachment unit 12, an interaction between the attachment incline surface 42 in the housing incline surface 48 can convert the lateral force into diagonal movement in which the attachment incline surface 42 slides across the housing incline surface 48.

Accordingly, the embodiments discussed herein provide locking mechanisms that facilitate engagement with longitudinal movement and disengagement with lateral and/or longitudinal movements. The engagement is therefore intuitive and comfortable for execution by a user. The engagement provides secure attachment that is controllably released with ease by a user.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A watch comprising:

a band having an attachment unit; and a housing comprising a channel configured to receive the attachment unit with a longitudinal movement of the attachment unit into the channel;

a longitudinal lock mechanism that, when the attachment unit is engaged to the housing, limits a longitudinal movement of the attachment unit out of the channel without limiting a lateral movement of the attachment unit within the channel; and a lateral lock mechanism that, when the attachment unit is engaged to the housing, limits the lateral movement of the attachment unit within the channel without limiting the longitudinal movement of the attachment unit out of the channel.

2. The watch of claim 1, wherein:
the longitudinal lock mechanism comprises:
a recess of the housing; and
a catch member of the attachment unit, the catch member being retractably biased to extend into the recess when the attachment unit is within the channel; and
the lateral lock mechanism comprises:
an opening of the attachment unit; and
a locking member of the housing, the locking member being configured to releasably engage the attachment unit within the opening.

3. The watch of claim 2, wherein the recess comprises:
a ledge on a longitudinal side of the catch member to retain the catch member within the recess; and
a ramp on a lateral side of the catch member to guide the catch member laterally out of the recess.

4. The watch of claim 2, wherein opening comprises a first portion with a first lateral width and a second portion with a second lateral width greater than the first lateral width.

5. The watch of claim 4, wherein the locking member is moveable:
to be within the first portion of the opening to limit the lateral movement of the attachment unit within the channel; and
to be within the second portion of the opening to allow the lateral movement of the attachment unit within the channel.

6. The watch of claim 2, wherein, when the catch member is within the recess, an attachment incline surface of the attachment unit is laterally separated within the channel from a housing incline surface of the housing.

7. The watch of claim 1, wherein the attachment unit comprises an attachment incline surface and the housing comprises a housing incline surface for contacting the attachment incline surface and guiding the attachment unit longitudinally out of the channel upon application of a lateral force to the attachment unit.

8. The watch of claim 1, wherein the attachment unit comprises attachment incline surfaces and the housing comprises housing incline surfaces, and a maximum lateral distance between the attachment incline surfaces is greater than a maximum lateral distance between the housing incline surfaces.

9. A housing of a watch, the housing comprising:
a channel for receiving an attachment unit of a band;
a recess within the channel, configured to receive a catch member of the attachment unit, and comprising:
a ledge on a longitudinal side of the recess to retain the catch member longitudinally within the recess; and
a ramp on a lateral side of the recess to guide the catch member laterally out of the recess; and
a locking member configured to releasably engage the attachment unit with an engagement portion extending into the channel to limit a lateral movement of the attachment unit within the channel until the locking member is actuated with an interface portion accessible to a user and positioned outside the channel.

10. The housing of claim 9, wherein the locking member is biased to have the interface portion flush with a body of the housing.

11. The housing of claim 9, wherein the recess is a first recess, the housing comprises a second recess within the channel, and the locking member is positioned laterally between the first and second recesses.

12. The housing of claim 9, wherein the channel is configured to allow longitudinal movement of the attachment unit into the channel and lateral movement of at least a portion of the attachment unit out of the channel.

13. The housing of claim 9, wherein the recess is configured to engage the attachment unit to limit a longitudinal movement of the attachment unit out of the channel without limiting a lateral movement of the attachment unit within the channel.

14. An attachment unit of a band for securing a housing of a watch to a user, the attachment unit comprising:
a catch member that is retractably biased to engage the housing; and
an opening configured to receive a locking member of the housing, the opening comprising:
a first portion for receiving the locking member to limit a lateral movement of the attachment unit relative to the housing; and
a second portion for receiving the locking member to allow the lateral movement of the attachment unit relative to the housing wherein the first portion has a first lateral width and the second portion has a second lateral width greater than the first lateral width.

15. The attachment unit of claim 14, further comprising an attachment incline surface for contacting a housing incline surface of the housing to guide the attachment unit out of the housing.

16. The attachment unit of claim 14, wherein the catch member is retractably biased to extend into a recess of the housing when the attachment unit is within the housing.

17. The attachment unit of claim 14, wherein the catch member is a first catch member, the attachment unit comprises a second catch member that is retractably biased to engage the housing, and the opening is positioned laterally between the first and second catch members.

* * * * *